US005551351A

United States Patent [19]

Hardin

[11] Patent Number: 5,551,351

[45] Date of Patent: Sep. 3, 1996

[54] BOLSTER GIB

[75] Inventor: Don R. Hardin, Albertville, Ala.

[73] Assignee: Progressive Rail Services Corporation, Albertville, Ala.

[21] Appl. No.: 393,705

[22] Filed: Feb. 24, 1995

[51] Int. Cl.[6] ..... B61D 49/00

[52] U.S. Cl. ..... 105/226

[58] Field of Search ..... 105/226, 227, 105/229, 230, 198.2, 198.4, 198.5, 207, 191

[56] References Cited

U.S. PATENT DOCUMENTS 2,161,513 6/1939 Hammerstrom ..... 105/226
3,924,542 12/1975 Mac Donnell et al. ..... 105/226
4,092,932 6/1978 Mac Donnell ..... 105/207
4,491,075 1/1985 Neumann ..... 105/207

*Primary Examiner*—Mark T. Le
*Attorney, Agent, or Firm*—James E. Bradley

[57] ABSTRACT

A freight car truck utilizes a bolster which extends laterally between two side frames. The bolster outer ends extend through openings in the side frames. Four gibs are located on each outer end. Two are inboard of the side frame and two outboard of the side frame. The gibs are generally rectangular metal bars welded to vertical sides of the bolster. Each gib has a gage side which is perpendicular to the mounting side and which faces an adjacent gib. A seam, formed during manufacturing of the gib, extends around the longitudinal perimeter of the gib. The seam is in a plane which is parallel with the flat portion of the gage side and does not intersect the gage side.

14 Claims, 2 Drawing Sheets

BOLSTER GIB

BACKGROUND OF THE INVENTION

1. Field of the Invention

This invention relates in general to rail freight cars, and in particular to an improved bolster for a rail freight car truck.

2. Description of the Prior Art

Conventional freight rail cars are supported on rails by two trucks or wheel carriages. Each truck has two side frames, with a pair of wheels supported in each side frame. The side frames extend longitudinally, parallel with the rails. A bolster extends between the side frames. The bolster supports the car body and mounts to the side frames. The bolster has outer ends which extend through openings in the side frames. Coil springs also locate in the openings, allowing vertical movement of the bolster relative to the side frames to accommodate irregularities in the rail surface. The side frames have wear plates in the interior of the opening which are engaged by friction blocks on the bolsters in rubbing contact as the bolster outer ends move up and down with movement of the coil springs. The wear plates also have exterior portions located on the inner and outer sides of the side frame.

The bolster has four gibs on each outer end. The gibs are located on each opposite vertical side member, one on each side of the pocket and the bolster. The gibs are solid metal bars positioned to come into contact with the exterior portions of the wear plates due to relative lateral movement between the side frames and the bolster. A selected clearance or gap between the gibs and the wear plates of the side frame will be provided. Relative lateral movement causes the gibs, however, to come into contact with the side frame wear plates from time to time. Eventually, the gibs become worn out of tolerance and need to be replaced.

Where replacing the gibs, the worn gibs are ground off the bolster and new gibs are welded to the vertical sides of the bolster on each side of each pocket. A gage is employed to ensure that the distance between the gibs is accurate. In the prior art, the replacement gibs are solid metal forgings. The forging process produces a seam, which is a flat protruding band that extends longitudinally around the perimeter of the gib. In the prior art, the forging process results in the seam extending in a plane that is perpendicular to the gage side of the gib. The gage side of the gib faces the gib on the opposite the pocket. The seam thus extends through the gage side of the gib. This produces an irregular surface making it difficult to achieve the proper gage. The gage surface would need to be ground smooth first. This results in additional manufacturing expense.

SUMMARY OF THE INVENTION

In this invention, the gibs are forged in a different manner so as to produce a seam that is perpendicular to the orientation of the prior art gib. The seam in this instance is located in a plane that is parallel with the gage side of the gib. The seam extends approximately equidistant from the gage side and the opposite facing side of the gib. The seam extends completely around the longitudinal perimeter of the gib, through the mounting side, over the upper and lower ends and down the distal side. The seam abuts the vertical side of the bolster when the gib is welded to the bolster.

BRIEF DESCRIPTION OF THE INVENTION

DETAILED DESCRIPTION OF THE INVENTION

Figure 1:
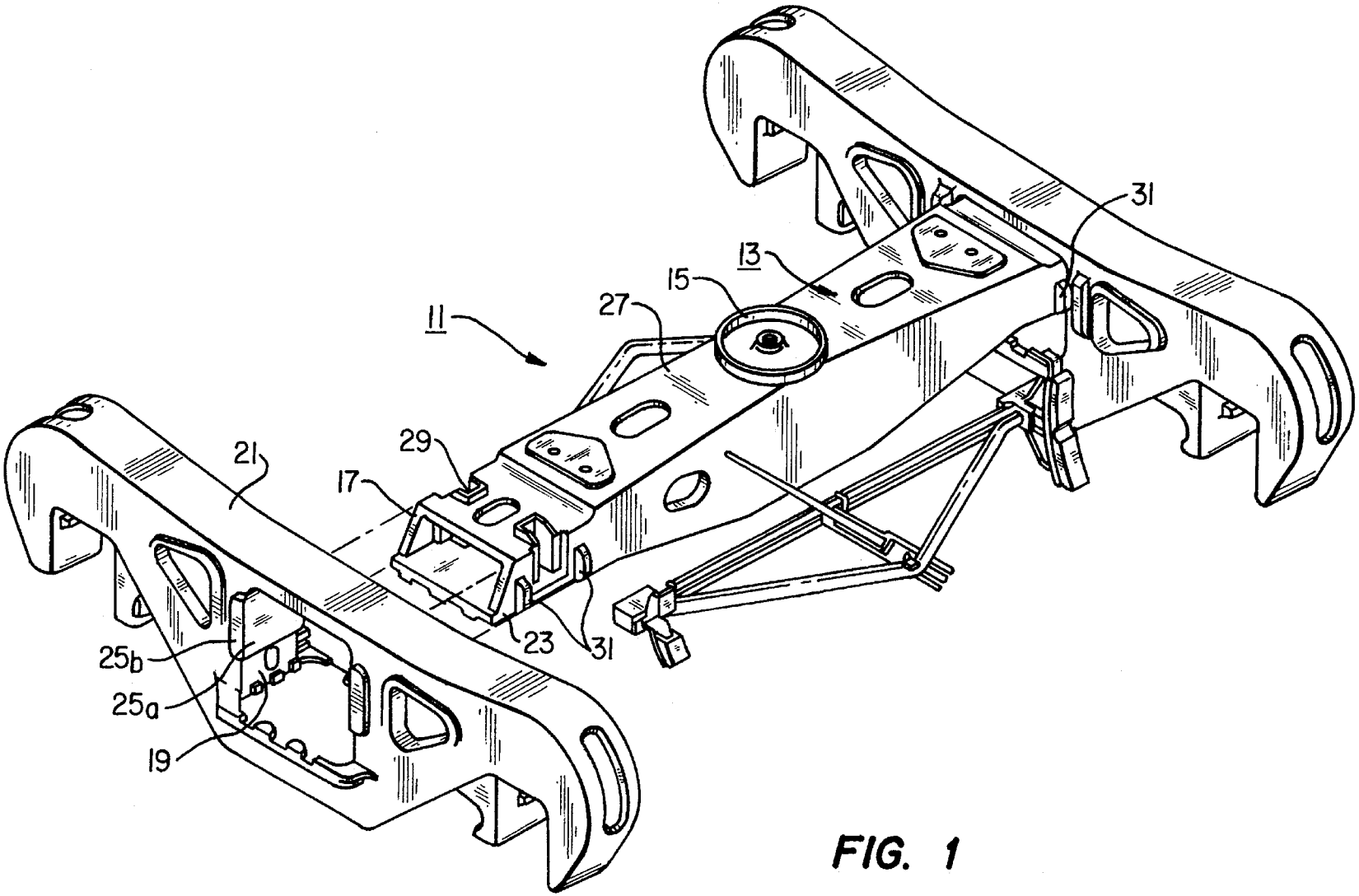
FIG. 1 is a perspective view illustrating portions of a conventional rail freight car truck having gibs constructed in accordance to this invention.

FIG. 1 shows one type of a conventional freight car truck 11 for location at one end of a freight car for supporting the freight car on rails. A variety of designs of trucks 11 are in existence, however, most have certain common features. A bolster 13 extends laterally, perpendicular to the longitudinal axis of the car body (not shown). Bolster 13 has a center plate cavity 15 which will support one end of the car body. Bolster 13 is a generally rectangular beam that has two outer ends 17 facing in opposite directions.

Outer ends 17 extends through openings 19 in side frames 21. Each side frame 21 extends in a longitudinal direction and rotatably supports a pair of wheels (not shown) which roll on the rails. A number of coil springs (not shown) are located in each side frame opening 19 and support the outer end 17 of bolster 13 by allowing some vertical movement of bolster outer end 17 relative to side frames 21.

Figure 2:
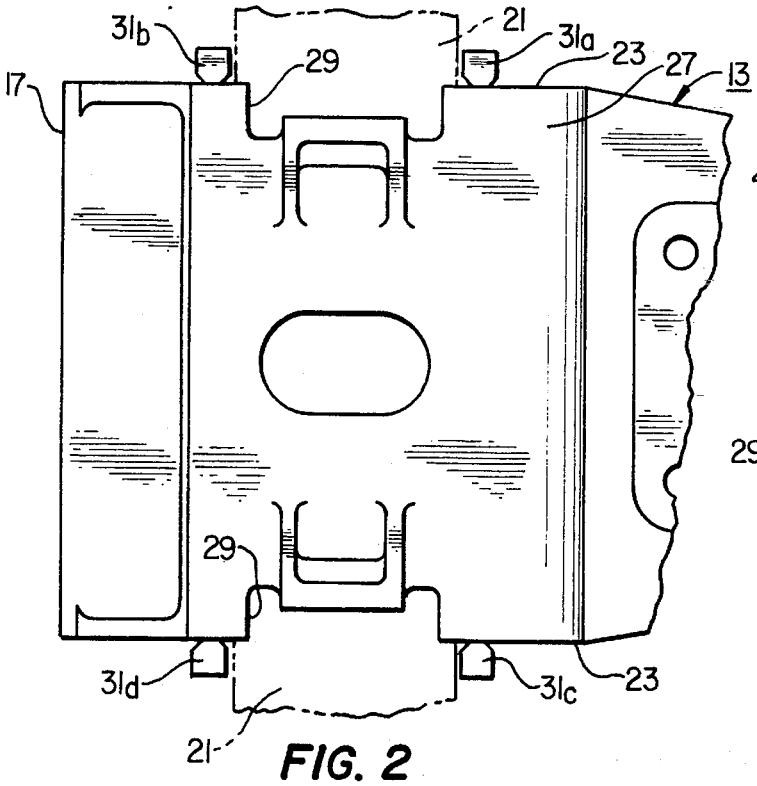
FIG. 2 is a top view of an outer end portion of the bolster of the truck of FIG. 1.

Bolster 13 has two vertical sides 23 which face in opposite directions. The vertical sides 23 will be closely spaced to interior wear plates 25*a* located within opening 19. Bolster 13 also has an upper side 27. A pocket 29 extends partially through the upper side 27 and through each vertical side 23 adjacent each outer end 17. Pocket 29 receives a friction wedge block (not shown) which will slidingly engage the wear plate interior portion 25*a*. Four gibs 31 are located on each outer end 17 of bolster 13. As shown in FIG. 2, gibs 31*a* and 31 *b* are located on one vertical side 23, while gibs 31*c* and 31*d* are located on the opposite vertical side 23. Gibs 31*a* and 31*c* are located inward of side frame 21. Gibs 31*b* and 31*d* are located outward of side frame 21. Gibs 31*a*, 31*b* are spaced apart a distance greater than the width of side frame 21, resulting in a gap. The gap allows some lateral movement of bolster 13 relative to side frames 21. During the lateral movement, gibs 31 may contact exterior wear plate portions 25*b* in frictional rubbing engagement.

Figure 4:
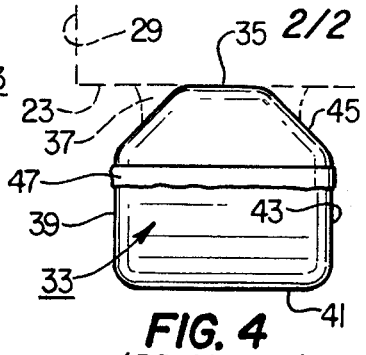
FIG. 4 (PRIOR ART)
FIG. 4 is an end view of a prior art gib.
Figure 3:
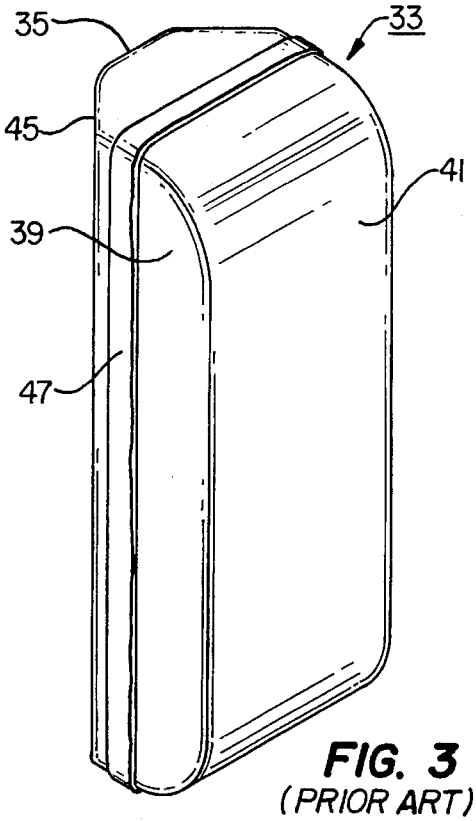
FIG. 3 (PRIOR ART)
FIG. 3 is an isometric view of a prior art gib.

When a freight car truck 11 is to be reconditioned, it may be necessary to replace gibs 31 due to wear that has occurred. Also, it may be necessary to rebuild pockets 29 as well as other components of the truck 11. In the prior art, to replace gibs 31, the worn gibs 31 will be removed by cutting and grinding. Replacement gibs will be manufactured and welded to the bolster 31. FIGS. 3 and 4 illustrate a replacement gib 33 of the prior art type. Gib 33 has a mounting side 35 that has a flat portion that abuts one of the vertical sides 23. Mounting side 35 is welded to vertical side 23 by a weld 37. Prior art gib 33 has a gage side 39 that is perpendicular to mounting side 35. A distal side 41 is parallel to mounting side 35. Oppositely facing side 43 is parallel to gage side 39. A bevel 45 is formed at the intersection of the mounting side 35 with oppositely facing side 43. A similar bevel 45 is formed at the intersection of mounting side 35 with gage side 39.

In the manufacturing process, gib 33 is formed by forging, which produces a seam 47. In the prior art forging process, the die is arranged so that seam 47 extends longitudinally around the perimeter of gib 33 and in a plane that is perpendicular to the plane of gage side 39. Seam 47 is a band that protrudes from gage side 39 and extends continuously in a straight line around the body of gib 33. In the prior art, seam 47 creates difficulty in achieving the desired gage dimension between gage sides 39 of adjacent gibs 33. The rough seam 47 makes it difficult to gage the dimension as well as making it difficult to gage the width of pocket 29. As a result, gage side 39 would have to be ground smooth.

Figure 6:
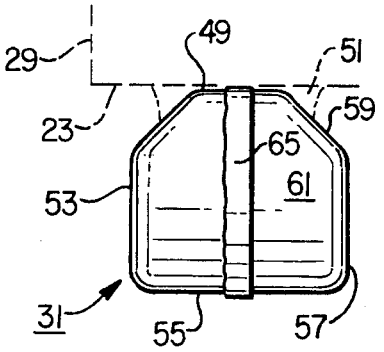
FIG. 6 is a top view of the gib of FIG. 5.
Figure 5:
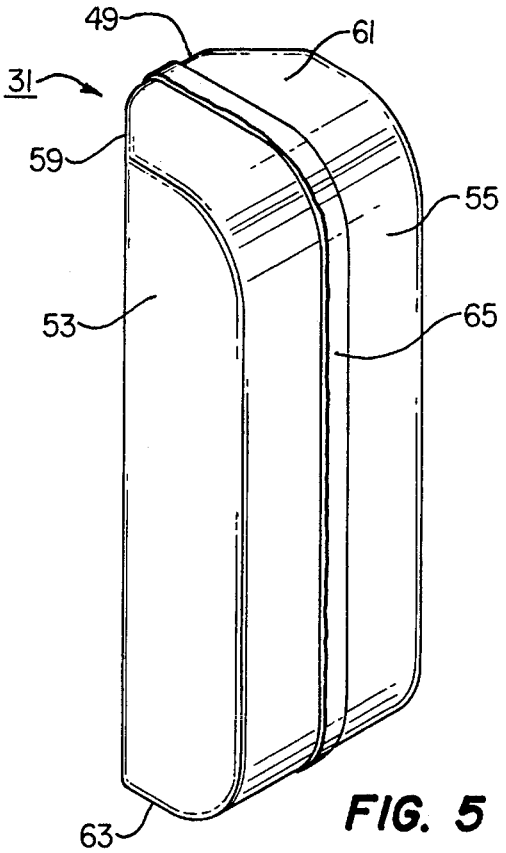
FIG. 5 is an isometric view of a gib constructed in accordance to this invention.

FIGS. 5 and 6 illustrates the preferred embodiment of gib 31. Gib 31 has the same overall generally rectangular configuration. Gib 31 has a mounting side 49 that is generally flat and abuts vertical side 23. Mounting side 49 is welded to vertical side 23 by a weld 51. Gib 31 has a gage side 53 that is perpendicular to mounting side 49. Distal side 55 is parallel to mounting side 49 and perpendicular to gage side 53. Oppositely facing side 57 is parallel to gage side 53 and perpendicular to distal side 55. A bevel 59 forms a junction between opposite facing side 57 and mounting side 49. A similar bevel 59 forms a junction between mounting side 49 and gage side 53. As shown in FIG. 5, upper end 61 and lower end 63 slope slightly toward each other and join distal side 55 at a significant radius. The length from lower end 63 to upper end 61 is considerably greater than the width from gage side 53 to oppositely facing side 57. The width from gage side 53 to oppositely facing side 57 is approximately the same as the thickness from mounting side 49 to distal side 55.

In the forging process for the preferred embodiment of gib 31, the die has been reconfigured so that the seam 65 is now in a plane that is parallel with gage side 53 rather than perpendicular as in the prior art. Seam 65 extends around a longitudinal perimeter through the mounting side 49, over the upper end 61, down the distal side 55, and back over the lower end 63. The seam 65 is in a plane perpendicular to mounting side 49 and protrudes from mounting side 49. Seam 65 protrudes a few thousandths of an inch from its respective surfaces. Its width is considerably less than the width from gage side 53 to oppositely facing side 57. In the preferred embodiment, one gib 31 has a width from gage side 53 to oppositely facing side 57 of one and one-fourth inch while the width of seam 65 is approximately one-eighth inch.

Because seam 65 does not pass through gage surface 53, no grinding of gage surface 53 is required. The location of seam 65 on mounting side 49 does not hamper welding each bevel 59 to the vertical side 23. The improved gib 31 makes reconditioning a bolster 13 less expensive and easier.

While the invention has been shown to only one of its form, it should be apparent to those skilled in the art that it is not so limited but is susceptible to various changes without departing from the scope of the invention.

I claim:

1. In a rail car having a bolster which extends perpendicular to a longitudinal axis of the rail car, the bolster having oppositely extending outer ends, each of which extends through an opening in a side frame of the rail car, each of the outer ends having oppositely facing first and second vertical sides, a pair of outer gibs on the first and second vertical sides and positioned to be on the outer side of the side frame, and a pair of inner gibs on the first and second vertical sides and positioned to be on the inner side of the side frame, each of the gibs being a solid metal bar, comprising:

a mounting side which has a flat portion that is parallel to and abuts one of the vertical sides and which has edge portions welded to one of the vertical sides;

a gage side which has a flat portion perpendicular to the mounting side, the gage sides of the inner and outer gibs on the first vertical side facing each other and the gage sides of the inner and outer gibs on the second vertical side facing each other; and a seam which extends along the mounting side and around a perimeter of the gib in a plane which passes through the gib and is parallel to and spaced from the flat portion of the gage side.

2. The rail car according to claim 1, wherein:

each of the gibs has an oppositely facing side which faces in a direction opposite of the gage side; and the seam is substantially equidistant between and spaced from the oppositely facing side and the gage side.

3. In a rail car having a bolster which extends perpendicular to a longitudinal axis of the rail car, the bolster having oppositely extending outer ends, each of which extends through an opening in a side frame of the rail car, each of the outer ends having oppositely facing first and second vertical sides, a pair of outer gibs on the first and second vertical sides and positioned to be on the outer side of the side frame, and a pair of inner gibs on the first and second vertical sides and positioned to be on the inner side of the side frame, each of the gibs being a solid metal bar, comprising:

a mounting side which has a flat portion and which is welded to one of the vertical sides;

a gage side which has a flat portion perpendicular to the mounting side, the gage sides of the inner and outer gibs on the first vertical side facing each other and the gage sides of the inner and outer gibs on the second vertical side facing each other; and a seam which extends along the mounting side and around a perimeter of the gib in a plane which is parallel with the flat portion of the gage side; and wherein:

each of gibs has a distal side which faces opposite the mounting side; and the seam extends along the distal side from a lower end to an upper end of each of the gibs.

4. In a rail car having a bolster which extends perpendicular to a longitudinal axis of the rail car, the bolster having oppositely extending outer ends, each of which extends through an opening in a side frame of the rail car, each of the outer ends having oppositely facing first and second vertical sides, a pair of outer gibs on the first and second vertical sides and positioned to be on the outer side of the side frame, and a pair of inner gibs on the first and second vertical sides and positioned to be on the inner side of the side frame, each of the gibs being a solid metal bar, comprising:

a mounting side which has a flat portion which is welded to one of the vertical sides;

a gage side which has a flat portion perpendicular to the mounting side, the gage sides of the inner and outer gibs on the first vertical side facing each other and the gage sides of the inner and outer gibs on the second vertical side facing each other; and a seam which extends around a perimeter of the gib in a plane which is parallel with the flat portion of the gage side; and wherein:

each of gibs has a distal side which faces opposite the mounting side;

each of the gibs has a lower end and an upper end; and the seam extends on each of the gibs along the distal side from the lower end to the upper end, along the lower end and the upper end, and along the mounting side.

5. In a rail car having a bolster which extends perpendicular to a longitudinal axis of the rail car, the bolster having oppositely extending outer ends, each of which extends through an opening in a side frame, each of the outer ends having oppositely facing first and second vertical sides, a pair of outer gibs on the first and second vertical sides and positioned to be on the outer side of the side frame, and a pair of inner gibs on the first and second vertical sides and positioned to be on the inner side of the side frame, each of the gibs being a solid metal bar, comprising:

a mounting side which is substantially flat;

a gage side which is smooth, substantially flat, and perpendicular to the mounting side, the gage sides of the inner and outer gibs on the first vertical side facing each other and the gage sides of the inner and outer gibs on the second vertical side facing each other;

a distal side which faces opposite the mounting side;

an oppositely facing side which faces opposite the gage side;

a lower end and an upper end;

a seam occurring as a result of manufacturing of the gib, the seam extending in a continuous substantially straight line along the mounting side, upper and lower ends and distal side; and wherein the mounting side is welded to one of the vertical sides of the bolster.

6. The rail car according to claim 5, wherein the distal side is substantially parallel to the mounting side, and the oppositely facing side is substantially parallel to the gage side.

7. The rail car according to claim 5, wherein:

a bevelled corner is located at a junction of the mounting side with the gage side, and another bevelled corner is located at a junction of the mounting side with the oppositely facing side; and the weld of the mounting side to one of the vertical sides is located at the bevelled corner.

8. The rail car according to claim 5, wherein:

the seam is located in a plane that is substantially parallel to the gage side.

9. The rail car according to claim 5, wherein:

the seam is located substantially equidistant between the gage side and the oppositely facing side.

10. The rail car according to claim 5, wherein:

the seam is a band with a width that is substantially less than a width of the gib from the gage side to the oppositely facing side.

11. A method of manufacturing and mounting a plurality of gibs to a bolster of a rail car extends perpendicular to a longitudinal axis of the rail car, the bolster having oppositely extending outer ends, each of which extends through an opening in a side frame of the rail car, each of the outer ends having oppositely facing first and second vertical sides, the method comprising:

forming a plurality of the gibs, each being a solid metal bar with a substantially flat mounting side, a substantially flat gage side perpendicular to the mounting side, and a seam which extends around a perimeter of the gib and along the mounting side in a plane which passes through the gib and is substantially parallel with and spaced from the gage side; then, for each of the outer ends:

welding two of the gibs to the bolster, with their mounting sides in abutment with the first and second vertical sides at a position which will be inward of one of the side frames; and welding the other two of the gibs to the bolster, with their mounting sides in abutment with the first and second vertical sides at a position which will be outward of one of the side frames and with the gage sides of the gibs on the first vertical side facing each other and the gage side of the gibs on the second vertical side facing each other.

12. The method according to claim 11, wherein the step of forming a plurality of the gibs further comprises:

forming for each of the gibs an oppositely facing side which faces opposite the gage side and is substantially parallel to the gage side; and locating the seam in a position substantially midway between the gage side and the oppositely facing side.

13. A method of manufacturing and mounting a plurality of gibs to a bolster of a rail car which extends perpendicular to a longitudinal axis of the rail car, the bolster having oppositely extending outer ends, each of which extends through an opening in a side frame of the rail car, each of the outer ends having oppositely facing first and second vertical sides, the method comprising:

forming a plurality of the gibs, each being a solid metal bar with a substantially flat mounting side, a substantially flat gage side perpendicular to the mounting side, and a seam which extends around a perimeter of the gib in a plane which is substantially parallel with the gage side; then, for each of the outer ends:

welding two of the gibs to the bolster, with their mounting sides in abutment with the first and second vertical sides at a position which will be inward of one of the side frames; and welding the other two of the gibs to the bolster, with their mounting sides in abutment with the first and second vertical sides at a position which will be outward of one of the side frames, with the gage sides of the gibs on the first vertical side facing each other and the gage sides of the gibs on the second vertical side facing each other; and wherein the step of forming a plurality of the gibs further comprises:

forming for each of the gibs upper and lower ends and a distal side which faces opposite the mounting side and is substantially parallel to the mounting side; and extending the seam along the distal side, the upper and lower ends and the mounting side in a plane substantially parallel with the gage side.

14. The method according to claim 11, wherein:

the step of forming a plurality of the gibs further comprises:

forming for each of the gibs an oppositely facing side which faces opposite the gage side and is substantially parallel to the gage side; and wherein the step of forming the seam comprises:

forming a protruding band with a width that is substantially less than a width of the gib from the gage side to the oppositely facing side.

* * * * *

UNITED STATES PATENT AND TRADEMARK OFFICE

CERTIFICATE OF CORRECTION

PATENT NO. : 5,551,351

DATED : September 3, 1996

INVENTOR(S) : DON R. HARDIN

It is certified that error appears in the above-indentified patent and that said Letters Patent is hereby corrected as shown below:

TITLE PAGE:

Assignee should be changed from PROGRESSIVE RAIL SERVICES CORPORATION to PROGRESS RAIL SERVICES CORPORATION.

Signed and Sealed this

Fifteenth Day of April, 1997

*Attest:*

Bruce Lehman

BRUCE LEHMAN

*Attesting Officer*

*Commissioner of Patents and Trademarks*